US008376424B2

(12) United States Patent
Bejune

(10) Patent No.: US 8,376,424 B2
(45) Date of Patent: Feb. 19, 2013

(54) DOOR HANDLE ASSEMBLY FOR AUTOMOTIVE VEHICLE

(75) Inventor: Daniel Carl Bejune, Southfield, MI (US)

(73) Assignee: Ford Global Technologies, Dearborn, MI (US)

( * ) Notice: Subject to any disclaimer, the term of this patent is extended or adjusted under 35 U.S.C. 154(b) by 260 days.

(21) Appl. No.: 12/891,013

(22) Filed: Sep. 27, 2010

(65) Prior Publication Data

US 2012/0074716 A1 Mar. 29, 2012

(51) Int. Cl.
*E05B 3/00* (2006.01)
*E05B 65/10* (2006.01)

(52) U.S. Cl. ..... 292/336.3; 292/DIG. 65

(58) Field of Classification Search ..... 292/336.3, 292/DIG. 65
See application file for complete search history.

(56) References Cited

U.S. PATENT DOCUMENTS

| | | | | | |
|---|---|---|---|---|---|
| 2,785,916 | A | | 3/1957 | Mutti | |
| 4,456,289 | A | * | 6/1984 | Badiali | 292/28 |
| 4,475,754 | A | * | 10/1984 | Arlauskas et al. | 292/336.3 |
| 4,783,103 | A | | 11/1988 | Schlegel | |
| 4,929,007 | A | * | 5/1990 | Bartczak et al. | 292/336.3 |
| 5,492,379 | A | * | 2/1996 | Staser et al. | 292/336.3 |
| 5,531,489 | A | * | 7/1996 | Cetnar | 292/225 |
| 5,887,918 | A | * | 3/1999 | Okada et al. | 292/336.3 |
| 5,934,817 | A | * | 8/1999 | Kim et al. | 403/196 |
| 6,092,845 | A | * | 7/2000 | Koenig | 292/225 |
| 6,099,052 | A | | 8/2000 | Spitzley | |
| 6,120,069 | A | | 9/2000 | Taranto | |
| 6,178,845 | B1 | * | 1/2001 | Gutschner | 74/502.4 |
| 6,264,257 | B1 | * | 7/2001 | Meinke | 292/336.3 |
| 6,361,091 | B1 | * | 3/2002 | Weschler | 292/336.3 |
| 7,210,716 | B2 | | 5/2007 | Mueller et | |
| 7,232,164 | B2 | * | 6/2007 | Lee | 292/336.3 |
| 7,475,924 | B2 | | 1/2009 | Meyer et al. | |
| 2002/0050720 | A1 | | 5/2002 | Helmer | |
| 2009/0001734 | A1 | | 1/2009 | Akahori et al. | |
| 2009/0256366 | A1 | * | 10/2009 | Abe | 292/336.3 |
| 2010/0171325 | A1 | * | 7/2010 | Takagai et al. | 292/336.3 |
| 2010/0253101 | A1 | * | 10/2010 | Seto et al. | 292/336.3 |
| 2011/0285150 | A1 | * | 11/2011 | Angelo | 292/336.3 |

FOREIGN PATENT DOCUMENTS

| | | | |
|---|---|---|---|
| DE | 3923726 A1 | * | 1/1991 |
| EP | 375275 A2 | * | 6/1990 |
| WO | WO 9303247 A1 | * | 2/1993 |
| WO | WO 2007042086 | * | 4/2007 |

* cited by examiner

*Primary Examiner* — Carlos Lugo
(74) *Attorney, Agent, or Firm* — Jerome R. Drouillard; Jason Rogers

(57) ABSTRACT

A door handle assembly for an automotive vehicle including a handle chassis and a handle strap having a lever actuator. A rotatable lever in contact with the lever actuator is mounted upon a release pivot attached to the handle chassis. A cable assembly includes a sheath having a first end which is held stationary, and a flexible core attached to the rotatable lever and to a door latch. A dimension control link maintains a predetermined distance between the first end of the cable sheath and the release pivot, so as to avoid unintentional operation of the door latch which could result from a crushing load imposed upon an outer portion of a vehicle door including the door handle assembly.

9 Claims, 3 Drawing Sheets

DOOR HANDLE ASSEMBLY FOR AUTOMOTIVE VEHICLE

TECHNICAL FIELD

This invention is related to a door handle for manually operating an exterior door of an automotive vehicle.

BACKGROUND

Automotive door latch systems play an important role in automotive safety because proper door operation is essential to maintaining a safe enclosure for vehicle occupants. Thus, door latch systems are called upon to allow easy opening and closing of doors during normal operation, while avoiding unwanted door opening during exceptional events.

It would be desirable to provide a door latch system, including a door handle assembly, which avoids unwanted door operation in the event of the imposition of a crushing load upon an exteriorly mounted door handle.

SUMMARY

According to an aspect of the present invention, a door handle assembly for an automotive vehicle includes a handle chassis and a handle grip having a first end pivoted to the handle chassis and a second end configured as a generally hook-shaped lever actuator. A rotatable lever is in operative contact with the lever actuator, with the rotatable lever being mounted upon a release pivot attached to the handle chassis. The door handle assembly also includes a cable assembly having an outer sheath with a first end which is held stationary, and a flexible core attached to the rotatable lever.

According to another aspect of the present invention, a dimensional control link, which is normally fastened to the handle chassis, maintains a predetermined distance between the first end of the cable sheath and the release pivot. The control link has a first port for retaining the first end of the sheath, and a second port receiving said release pivot.

According to another aspect of the present inventions, the cable assembly further includes a second end of the sheath, which is attached to a door latch.

According to another aspect of the present invention, the rotatable lever is configured as a counter mass lever having an engagement pin meshed with the lever actuator of the handle grip, so that rotation of the counter mass lever causes the flexible core to be pulled, opening the door latch.

It is an advantage of the present door handle assembly that proper door latch operation will be maintained notwithstanding exceptional events such as the imposition of a deformative, crushing load upon the exterior door handle.

Other advantages, as well as features of the present invention, will become apparent to the reader of this specification.

DESCRIPTION OF INVENTION

Figure 1:
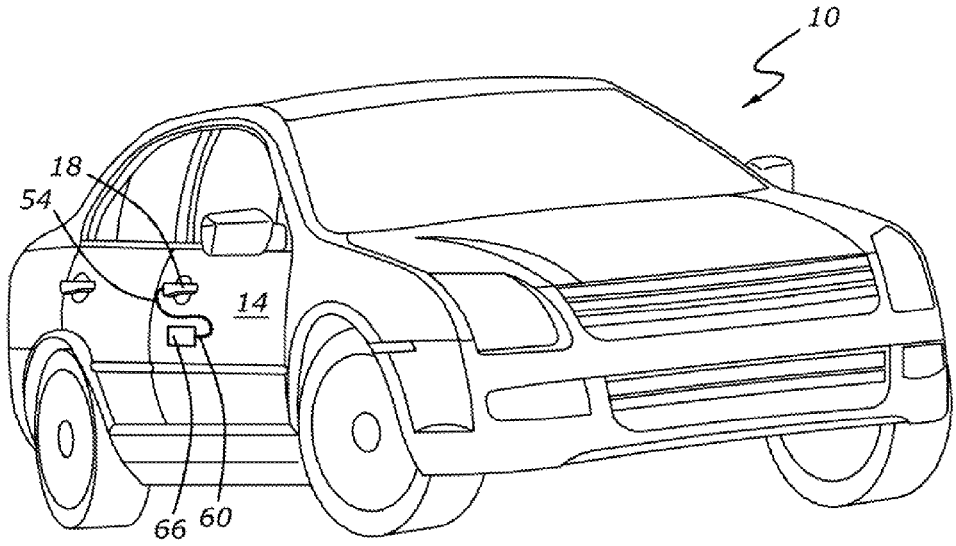
FIG. 1 is a perspective view of an automotive vehicle having a door handle assembly according to the present invention.

As shown in FIG. 1, automobile 10 has a door, 14, with a door latch system including an external handle assembly, 18. Handle assembly 18 activates a latch assembly, 66, by a cable, 54, which has a sheath end, 60, attached to latch assembly 66.

Figure 2:
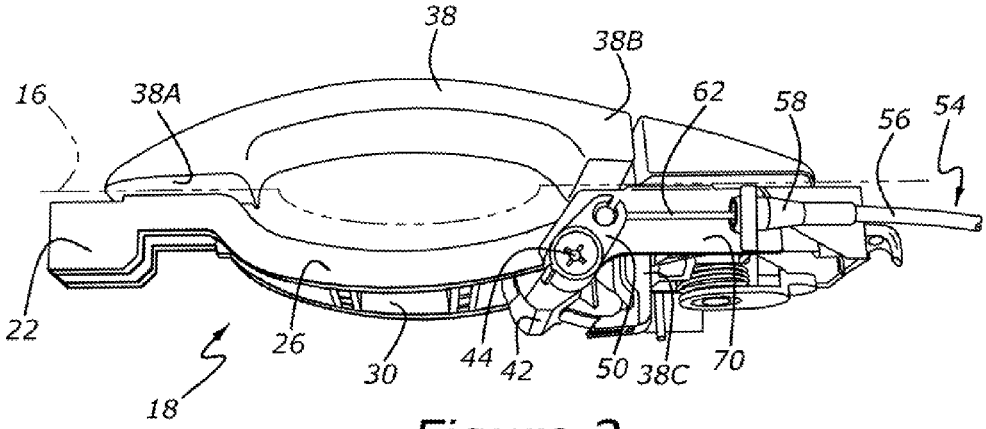
FIG. 2 is a perspective view of a door handle assembly according to the present invention.
Figure 3:
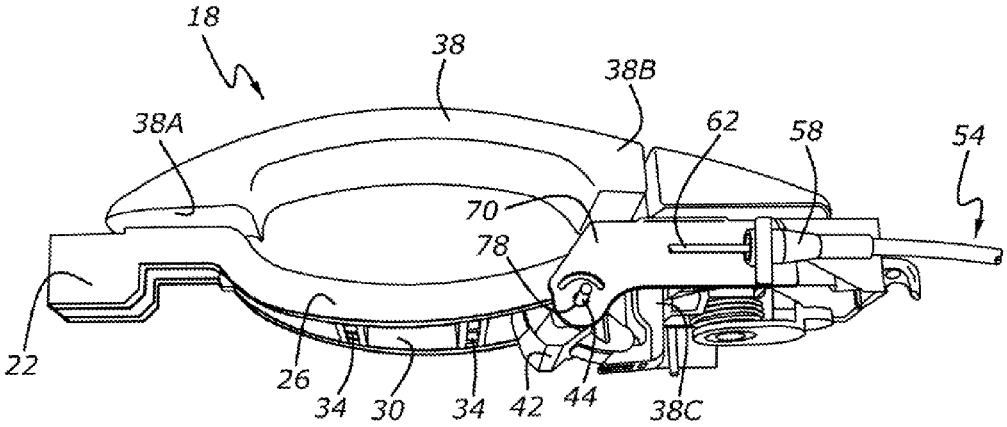
FIG. 3 is similar to FIG. 2, but is partially cut away to show a dimension control link according to an aspect of the present invention.
Figure 5:
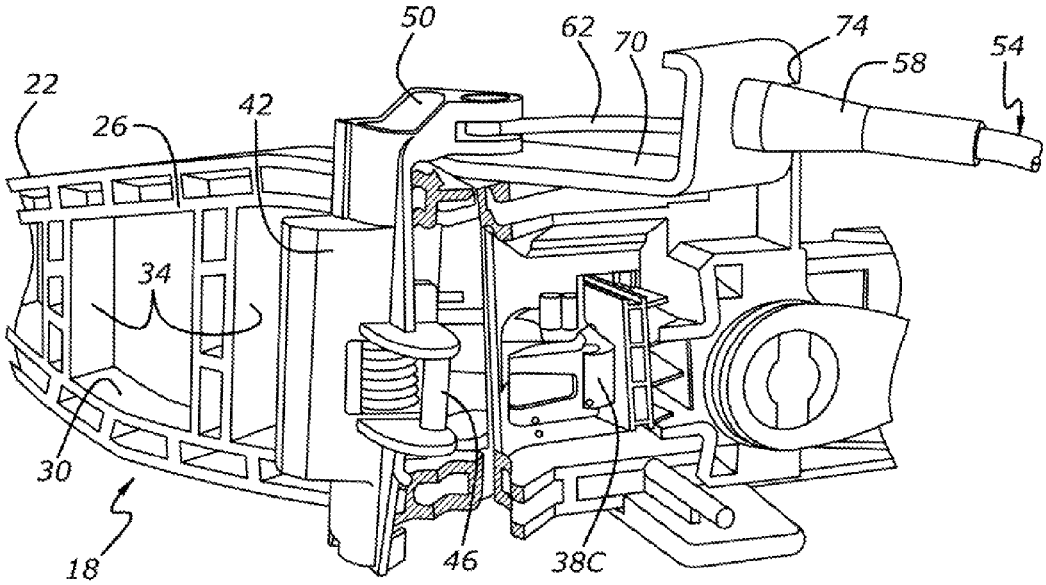
FIG. 5 is an outward-looking perspective view of the door handle assembly depicted in FIG. 4.

FIGS. 2-3 show various construction features of the present door handle assembly, which is mounted through door outer panel 16 (FIG. 2). The outside portion of door handle assembly 18 includes a handle grip, 38, having a first end, 38A, which is pivoted to a handle chassis, 22. A second end, 38B, of handle grip 38 is configured with a hook-shaped lever actuator, 38C. Lever actuator 38C meshes with an engagement pin, 46, (FIG. 5). Engagement pin 46 is mounted upon rotatable lever 42, which is configured as a counter mass lever.

When handle grip 38 is pulled outwardly by a motorist, second end 38B and lever actuator 38C also move outwardly, causing rotatable lever 42 to rotate in a counterclockwise direction, as viewed in FIG. 2. This will actuate door latch assembly 66 through the action of cable assembly 54, as explained below.

Cable assembly 54 has a flexible core, 62, which slides within a sheath, 56, having a first sheath end 58, which is held stationary with respect to handle chassis 22, so as to maintain first sheath end 58 in a stationary position. Cable sheath 56 has a second sheath end, 60, which is mounted to door latch assembly 66 (FIG. 1). As is the case with most cable-operated devices, movement of cable sheath 56 relative to cable core 62 must be controlled to assure proper operation of the latch system.

Flexible core 62 extends between a crank end, 50, incorporated within counter mass lever 42, and latch assembly 66. Thus, when counter mass lever 42 is rotated counterclockwise by handle grip 38, including lever actuator 38C, core 62 will be pulled a small distance from sheath 56, and latch assembly 66 will be opened. The present invention is intended to prevent opening of latch assembly 66 when handle strap 38 has not been pulled outwardly.

As shown in FIG. 3, first sheath end 58 of cable assembly 54 is attached to upper rail 26 of handle chassis 22 by a dimension control link, 70. Dimension control link 70 is preferably configured from a higher-strength, tougher material such as steel, which may be fastened to handle chassis 22 by heat staking, or by a discrete fastener, or by other means. Handle chassis 22 is preferably configured from a lightweight, tough material such as plastic. Those skilled in the art will appreciate in view of this disclosure, however, that other materials could be employed for one or both of control link 70 and handle chassis 22.

Dimension control link 70 has a first port, 74, (FIG. 5) for retaining first sheath end 58 of cable assembly 54. Dimension control link 70 also has a second port, 78 (FIG. 3), which receives release pivot 44, upon which rotatable lever/counter mass lever 42 is mounted. Dimension control link 70 will maintain a first predetermined distance between first cable end 58 and release pivot 44. This is important because if one or both of upper rail 26 and lower rail 30, which are joined by cross members, 34, is caused to fracture and separate in response to a crushing load imposed upon door 14 in the vicinity of door handle 18, dimension control link 70 will function as shown in FIGS. 4 and 5 to prevent cable core 62 from being withdrawn from sheath 56 by more than a second predetermined distance which is less than the distance necessary to open latch 66.

Figure 4:
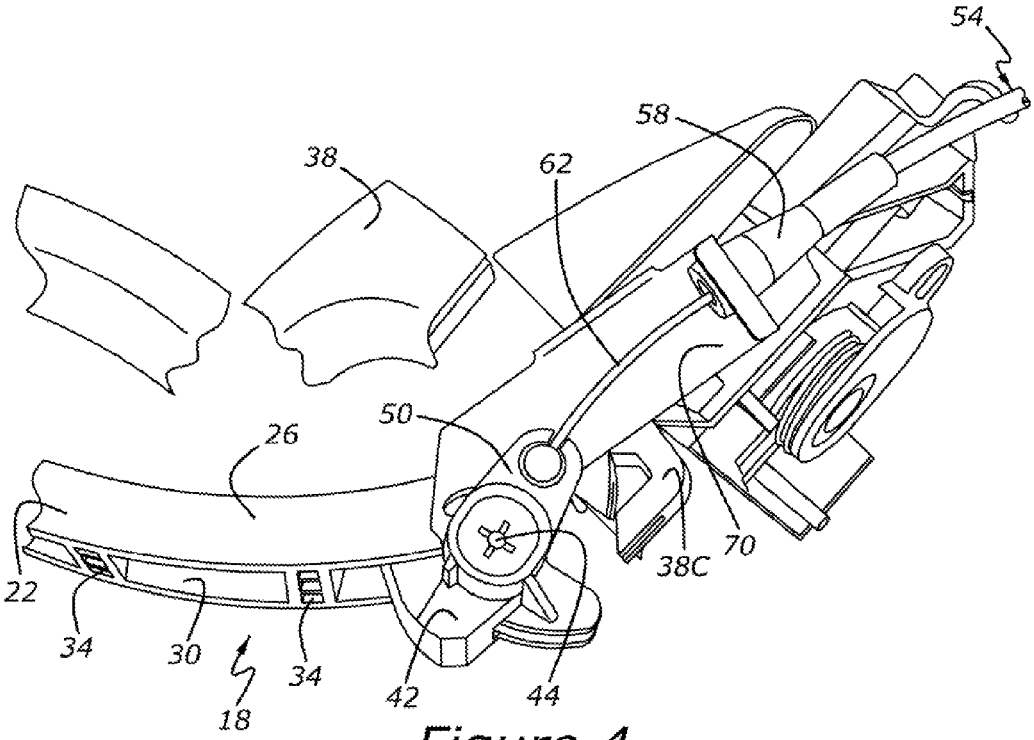
FIG. 4 is a perspective view showing the door handle assembly of FIGS. 2 and 3 following the imposition of a crushing load upon an exterior portion of a door including the present door handle.

FIG. 4 shows handle strap 38 as being fractured, and FIG. 5 shows upper rail 26 and lower rail 30 as being fractured in proximity to control link 70. But, because dimension control link 70 prevents release pivot 44 and lever 42 from migrating away from first cable end 58 to any appreciable extent, a dislocation caused by the fractured handle chassis rails will not cause latch 66 to open. And, this will be true even if dimension control link 70 is caused to separate from handle chassis 22 during an impact event.

The foregoing invention has been described in accordance with the relevant legal standards, thus the description is exemplary rather than limiting in nature. Variations and modifications to the disclosed embodiment may become apparent to those skilled in the art and fall within the scope of the claimed invention.

What is claimed is:

1. A door handle assembly for an automotive vehicle, comprising:

a handle chassis;

a handle grip having a first end pivoted to the handle chassis and a second end comprising a lever actuator;

a rotatable lever in operative contact with said lever actuator, with said rotatable lever being mounted upon a release pivot attached to said handle chassis;

a cable assembly comprising a sheath having a first end which is held stationary, with a flexible core attached to said rotatable lever, wherein said cable assembly further comprises a second end of said sheath attached to a door latch; and a dimensional control link maintaining a predetermined distance between the first end of the sheath and the release pivot, with the control link having a first port retaining the first end of the sheath and a second port receiving said release pivot, with said control link being fastened to sand handle chassis.

2. The door handle assembly according to claim 1, wherein said rotatable lever comprises a counter mass lever having an engagement pin meshed with a generally hook-shaped lever actuator incorporated within said handle grip.

3. The door handle assembly according to claim 2, wherein said lever actuator interacts with said engagement pin on said counter mass lever to pull said flexible core, whereby a latch attached to said cable assembly will be opened when said handle grip is pulled to a door-opening position.

4. The door handle assembly according to claim 1, wherein said handle chassis is mounted to an automotive door in proximity to an outer panel of said door.

5. The door handle assembly according to claim 1, wherein said control link is formed from steel, and said handle chassis is formed from plastic.

6. A door handle assembly for an automotive vehicle, comprising:

a plastic handle chassis attached to an automotive door;

a handle grip having a first end pivoted to the handle chassis and a second end comprising a linear actuator;

a rotatable counter mass lever in operative contact with said linear actuator, with said counter mass lever being mounted upon a release pivot attached to said handle chassis;

a cable assembly comprising a sheath having a first end which is held stationary, with a flexible core attached to said counter mass lever, wherein said cable assembly further comprises a second end of said sheath attached to a door latch; and a dimension control link attached to said handle chassis, with said control link maintaining a first predetermined distance between the first end of the sheath and the release pivot, and with the control link having a first port retaining the first end of the sheath and a second port receiving said release pivot, whereby breakage and separation of said handle chassis in proximity to said control link will not cause said flexible core to be pulled, relative to said first end of said sheath by more than a second predetermined distance.

7. The door handle assembly according to claim 6, wherein said linear actuator interacts with an engagement pin on said counter mass lever to pull said flexible core, whereby a latch attached to said cable assembly will be opened.

8. A door latch system for an automotive vehicle, comprising:

a handle chassis comprising upper and lower rails joined by a plurality of cross members;

a handle grip having a first end pivoted to the handle chassis and a second end comprising a linear actuator;

a counter mass lever attached to a release pivot mounted to said upper and lower rails, with said counter mass lever being in operative contact with said linear actuator;

a cable assembly comprising it sheath having a first end which is held stationary, with a flexible core having a first end attached to said counter mass lever, wherein said cable assembly further comprises a second end of said sheath attached to a door latch;

a latch assembly attached to a second end of said cable sheath and to a second end of said flexible core; and a dimension control link fastened to said handle chassis, with said control link maintaining a first predetermined distance between the first end of the sheath and the release pivot, with the control link having a first port retaining the first end of the sheath and a second port receiving said release pivot, whereby breakage and separation of said handle chassis caused by imposition of a crushing load to said handle chassis at a location between the first port and the second port of said link will not permit said counter mass lever to pull said flexible core relative to said first end of said sheath by more than a second predetermined distance, thereby preventing said latch assembly from opening as a result of said separation.

9. The door latch system according to claim 8, wherein said handle chassis is formed from plastic, and said control link is formed from steel.

* * * * *